US006663476B1

(12) United States Patent
Story et al.

(10) Patent No.: US 6,663,476 B1
(45) Date of Patent: Dec. 16, 2003

(54) PORTABLE MULTI-PURPOSE RAIL GRINDING MACHINE

(75) Inventors: Ralph F. Story, Mayfield, KY (US); Johnny D. Burnett, Paducah, KY (US)

(73) Assignee: Matweld, Inc., Paducah, KY (US)

( * ) Notice: Subject to any disclaimer, the term of this patent is extended or adjusted under 35 U.S.C. 154(b) by 0 days.

(21) Appl. No.: 10/118,820

(22) Filed: Apr. 9, 2002

(51) Int. Cl.[7] ..... B24B 23/00
(52) U.S. Cl. ..... 451/347; 451/429
(58) Field of Search ..... 451/347, 57, 58, 451/65, 344, 429; 15/54, 55

(56) References Cited

U.S. PATENT DOCUMENTS 3,882,645 A * 5/1975 Duecker ..... 451/347
RE32,979 E * 7/1989 Panetti ..... 451/65
5,303,514 A * 4/1994 Oishibashi et al. ..... 451/347
5,575,709 A * 11/1996 Hertelendi et al. ..... 451/347
2002/0019205 A1 * 2/2002 Huboud-Peron ..... 451/429

OTHER PUBLICATIONS

Frog/Profile Grinder, Matweld website, 1997.
Frog & Switch Grinder, Matweld website, 1997.
Straight Stone Grinder, Matweld website, 1997.
Profile Grinder, Matweld website, 1997.
Cup Stone Grinder, Matweld website, 1997.
Rail Surfacing Guide, Matweld website, 1997.

* cited by examiner

*Primary Examiner*—Dung Van Nguyen
(74) *Attorney, Agent, or Firm*—Lloyd L. Zickert

(57) ABSTRACT

A portable multi-purpose rail grinding machine for grinding field welds, switch points and frogs, including a hydraulically driven grinder with a disk-shaped stone adjustably mounted on a frame for setting the grinding stone between horizontal and vertical positions, an adjustable rail assembly including a hook-shaped guide member and a flanged wheel guide member, one of which may be selectively chosen to guide movement along a rail, and adjustably positionable handlebars for allowing the operator to control and manipulate the grinder from an ergonomic upright position.

18 Claims, 6 Drawing Sheets

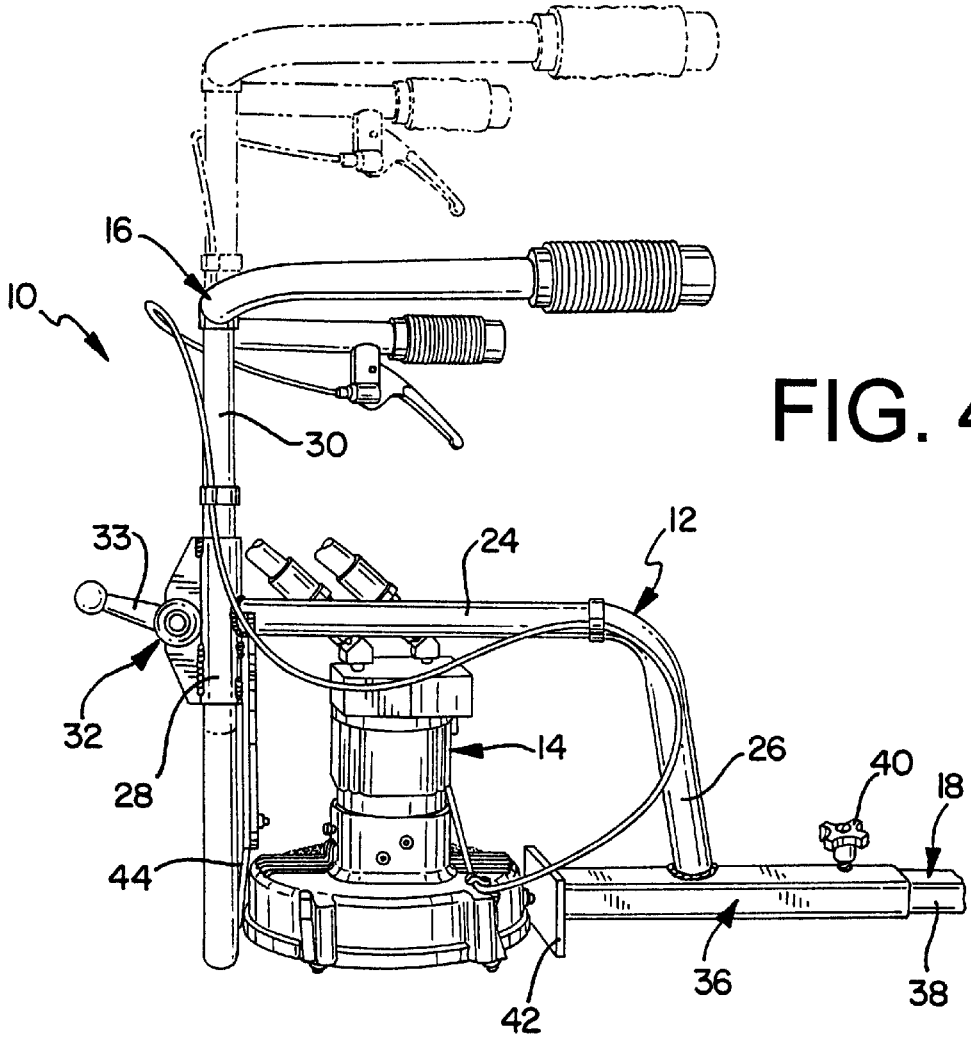
FIG. 4
FIG. 10
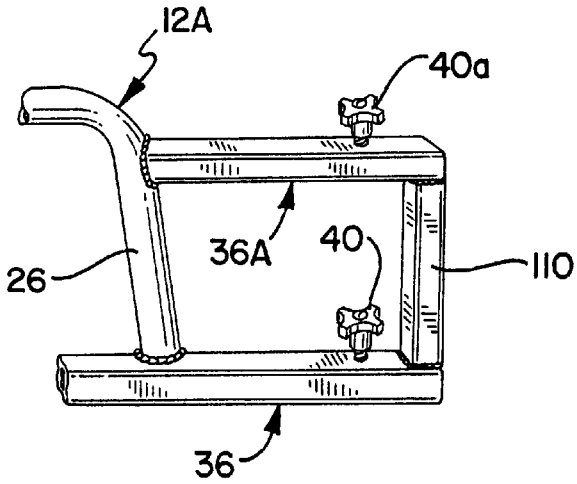

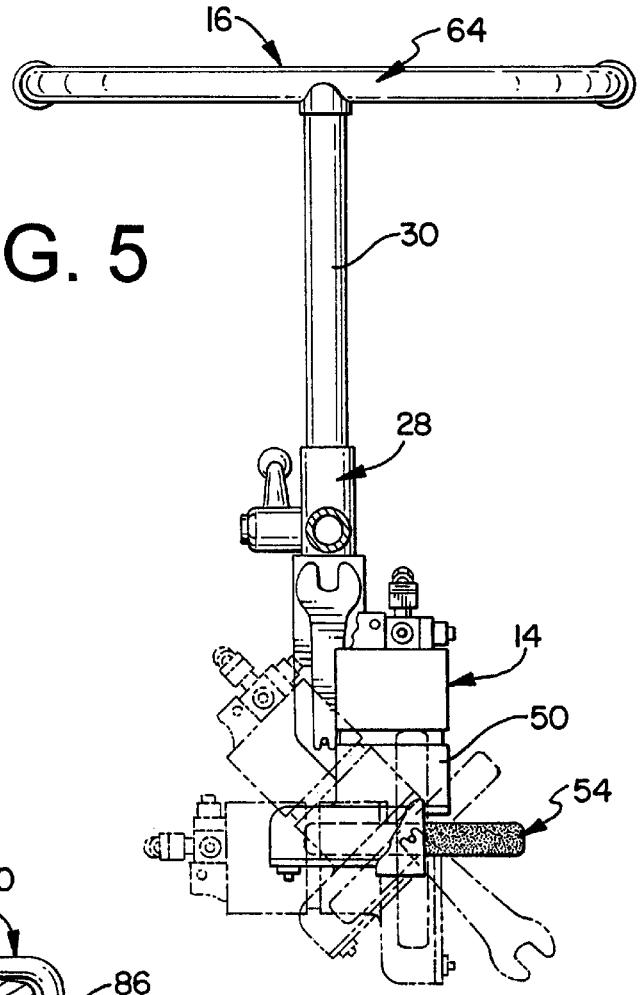
FIG. 5
FIG. 8
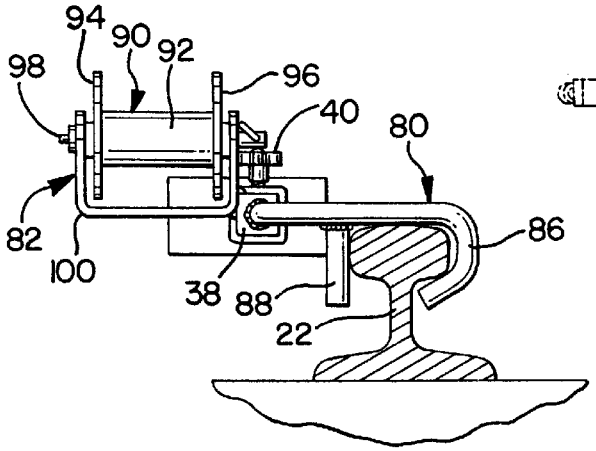
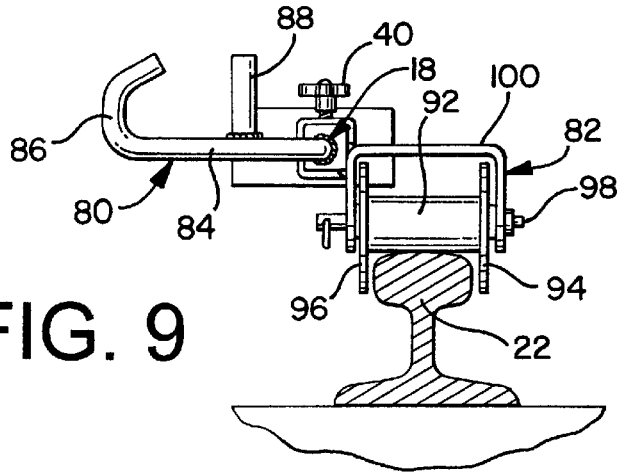
FIG. 9

PORTABLE MULTI-PURPOSE RAIL GRINDING MACHINE

This invention relates in general to a multi-purpose rail grinding machine for grinding field welds, switch points, and frogs, and more particularly to a hydraulically powered portable rail grinding machine having an ergonomic friendly frame to facilitate ergonomic operation.

BACKGROUND OF THE INVENTION

During the maintenance process of keeping railroad tracks in good operating condition, it is necessary that track or rail sections be replaced from time to time, switch points be ground to maintain proper operation of switches, and frogs repaired to maintain their proper operation. This maintenance process usually involves some form of welding such as to join two sections of rail together or to build up worn away material on switches and frogs. Following the welding processes, it is necessary to grind the welds or welded areas to match existing rail profiles or frog contours.

Heretofore, it has been common practice for maintenance workers to carry out the grinding operations by the use of hand-held grinders. These grinding operations entail back-breaking work because of the posture positions a worker must endure to position the grinding stone of the grinder at the proper angle to perform the necessary grinding tasks. Accordingly, such grinding tasks often lead to back injuries and lost time or accidents.

It is also common practice that two to three different types of grinders be made available for performing the various grinding tasks in repairing track wherein each of the grinders is used for a specific grinding task. For example, one such grinder, made and sold by Matweld, Inc. of Paducah, Ky., serves to grind the top of a rail where it is needed to finish grind field welds or rail ends. Another grinder made and sold by Matweld, Inc. is a hand-operated grinder for use on field welds, frogs, and switch points which requires the operator to endure posture positions that cause bending of the back to position the grinder on the rail.

Another such type of grinder offered by Matweld, Inc. for grinding the tops of frogs and rail requires the operator to bend over and position the grinder at the grinding site. Matweld also offers a profile grinder that allows the operator to be in an upright position but is only useful for finish grinding of the field welds along the top and sides of the rail.

Matweld, Inc. also provides a heavy-duty frog and switch grinder that rolls along both rails but is not capable of being manipulated easily for handling all types of grinding operations.

A frog/profile grinder that is designed for grinding frogs and finish grinding of field welds which allows the operator to be in an upright position is also sold by Matweld, Inc.

SUMMARY OF THE INVENTION

The portable multi-purpose rail grinding machine of the invention eliminates the need for stocking multiple grinders, and allows the operator to always be in a good ergonomic upright work position, while serving to grind field welds, switch points, and frogs. The machine of the invention includes a multi-positionable grinding head and adjustable rail guide assembly for grinding rail profiles, switch points, and frogs. The portable grinding machine includes adjustable handlebars for the operator that not only are adjustable during the setup for various welding operations but also for the purpose of facilitating compact storage of the grinder. An on-off control lever having an optional safety device for preventing accidental starting of the grinding motor is mounted on one of the handlebars for facilitating operation by the operator. The grinding head is adjustable for positioning the disk-shaped grinding stone in horizontal, vertical, or in-between positions to handle the various grinding tasks needed to grind field welds, switch points and frogs. An adjustable rail guide assembly is provided for facilitating the different grinding operations and includes a hook-shaped guide for hooking over and sliding along the rail as the machine is moved relative to the rail. The rail guide assembly also includes a flanged wheel for riding on the rail that may be selectively used for certain grinding operations.

It is therefore an object of the present invention to provide a new and improved multi-purpose rail grinding machine for grinding field welds, switches, and frogs that includes an ergonomic work frame for allowing friendly ergonomic operation by a worker in a substantially upright position.

Another object of the present invention is in the provision of a multi-purpose rail grinding machine for grinding field welds, switch points, and frogs, which includes a grinder head that is adjustable to position a disk-shaped grinding stone in horizontal, vertical, or in-between orientations, while the operator maintains an upstanding posture to facilitate ergonomic operation of the machine.

Another object of the present invention is to provide a portable multi-purpose rail grinding machine for grinding field welds, switch points, and frogs having multiple rail guiding members for guiding movement of the machine along a rail during various grinding operations.

A still further object of the present invention is to provide a multi-purpose portable rail grinding machine for allowing an operator to manipulate the machine while in an upright standing position for any of the grinding operations and which thereby eliminates the need to have a number of different types of grinders that only perform the required grinding task and wherein the machine of the invention is light-weight and versatile.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 4 is a generally side elevational view but partially perspective of the machine of the invention with the adjustable rail guide assembly cut off and illustrating the adjustability of the handlebars between different elevations and positions;

FIG. 5 is a front elevational view of the machine of the invention with some parts omitted for purposes of clarity to illustrate some of the various positions the grinding stone can be adjusted, where the grinding stone is shown in solid and in horizontal position, and in phantom in angular and vertical positions;

FIG. 8 is a transverse sectional view taken through a rail and showing the guide assembly of the machine of the invention and particularly the hook-shaped member in engagement with the rail head;

FIG. 9 is a view similar to FIG. 8 but showing the flanged roller of the guide assembly in riding engagement with the rail; and FIG. 10 is a fragmentary perspective view of a modified frame having upper and lower receivers for the rail guide assembly.

DESCRIPTION OF THE INVENTION

Figure 1:
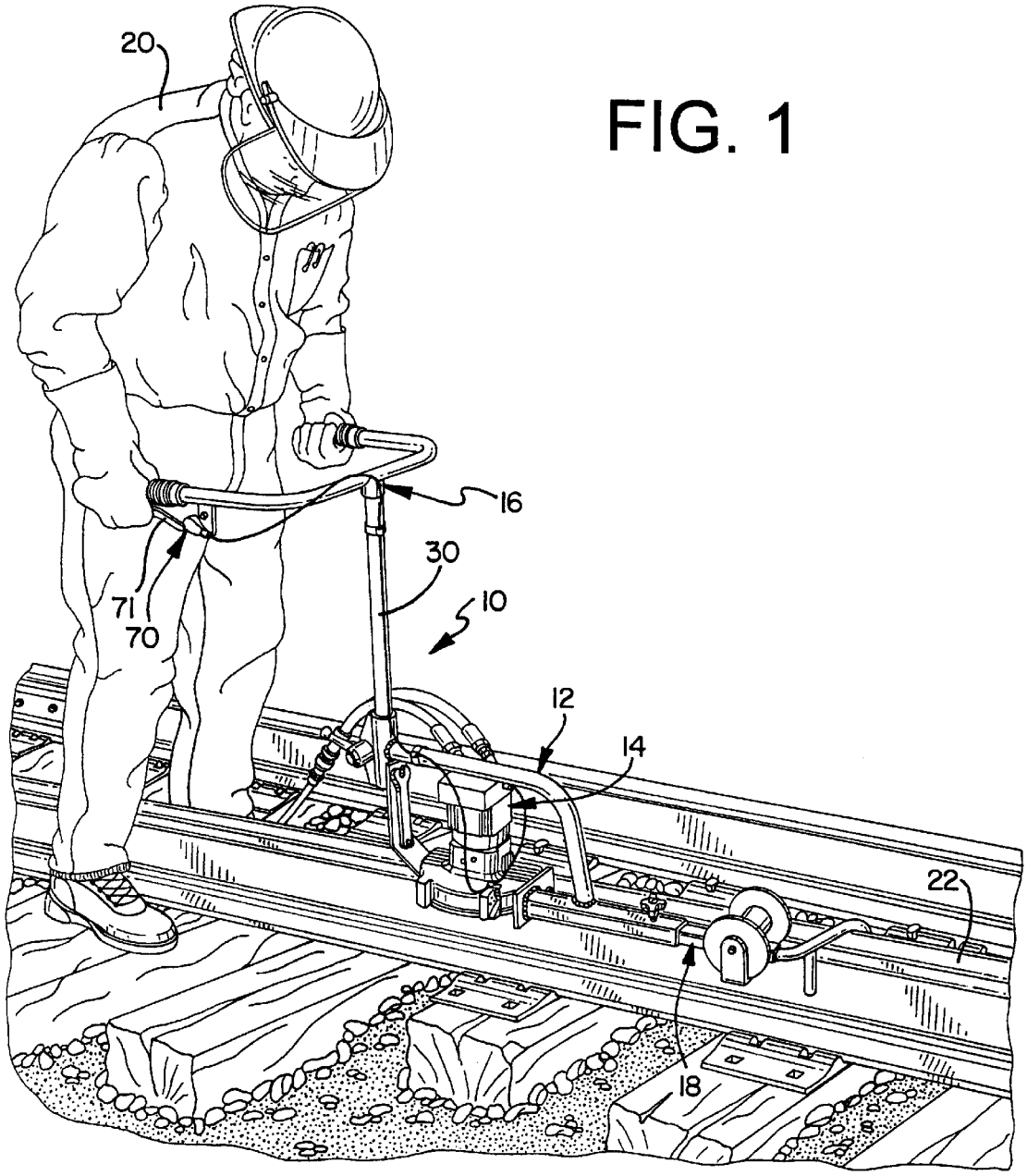
FIG. 1 is a perspective view of the rail grinding machine of the invention in association with rail or track and illustrating an operator in an upright position operating the machine and also illustrating the hook-shaped rail guide member of the adjustable rail guide assembly in engagement with the rail and also showing the grinding stone in its horizontally disposed position.
Figure 2:
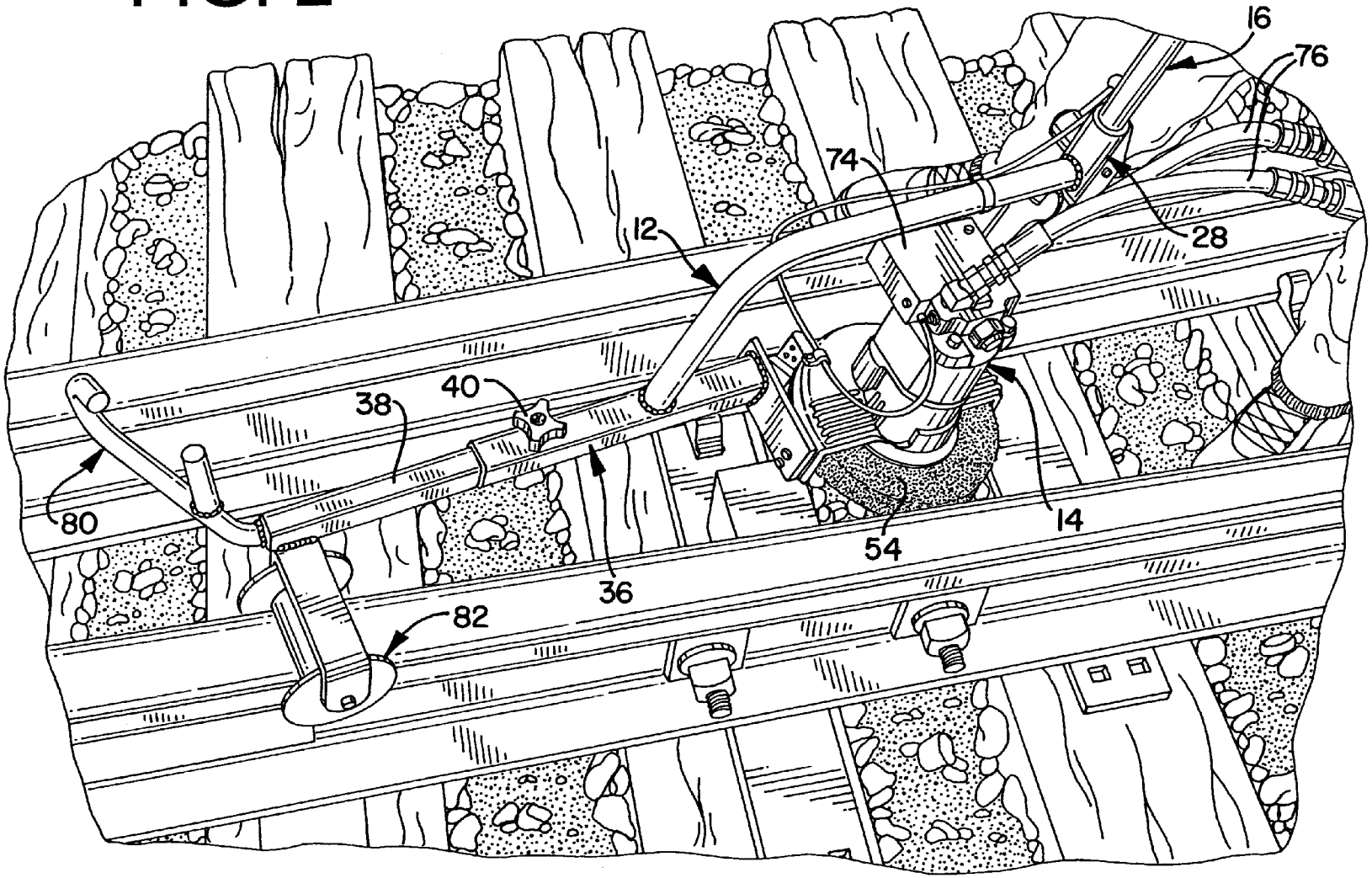
FIG. 2 is a perspective view of a part of the machine of the invention looking down from above and where the flanged wheel guide is on the track, and partially illustrating the position of the operator, and also showing the grinding stone in its horizontally disposed position.

Referring now to the drawings, and particularly to FIGS. 1 to 4, the portable upstanding multi-purpose grinding machine of the invention, generally designated by the numeral 10, includes a frame 12 having a grinding head or grinder 14 adjustably mounted thereon, a handlebar assembly 16 adjustably carried by the frame, and a rail guide assembly 18 adjustably carried by the frame. Thus, the machine can be set up for the various grinding tasks, including grinding field welds, switch points, and frogs.

The rail guide assembly 18 is at one end of the machine and serves to guide the frame as it moves along a rail, while manipulation of the machine by an operator 20 is accomplished by gripping the handlebar assembly 16 at the other end of the machine as the operator manually positions the grinder 14 in grinding position and moves the machine along a rail 22.

The frame 12 includes an L-shaped tubular bar having a horizontally extending portion 24 and a substantially vertically extending portion 26 extending downwardly from one end of the horizontal portion. Actually the vertical portion 26 extends downwardly and slightly away from the horizontal portion and is therefore at a slight angle to the horizontal portion. At the free end of the horizontal portion 24, a tubular socket 28 is suitably secured to the horizontal portion by welding or other suitable means and extends at right angles to the horizontal portion. Accordingly, the tubular socket 28 extends substantially vertically when the machine is disposed so that the horizontal portion 24 is in substantially parallel relation to the ground.

The tubular socket 28 is split and expandable to adjustably receive the round tubular vertical bar 30 of the handlebar assembly 16, as illustrated in FIG. 4. It will be appreciated the handlebars would be turned about 180 degrees and elevated to a comfortable handling position when operating the machine. Flanges are provided on the split edges of the tubular socket 28. A locking assembly 32 includes a handle 33 to which a threaded stud is suitably secured and extends through a hole in one flange and is threadedly received in a tapped hole in the other flange. Thus, tightening of the socket 28 by actuation of the handle 33 locks the tubular bar 30 of the handlebars in a selected position. Similarly, loosening of the socket by actuation of the handle allows adjustment of the handlebars.

At the lower end of the frame of vertical portion 26, a square tubular socket or receiver 36 is secured by welding or otherwise and disposed in a horizontal position substantially parallel to the horizontal portion 24 of the frame 12. The tubular socket 36 includes a portion extending forwardly of the vertical portion for adjustably receiving the square tubular bar 38 of the rail guide assembly 18. The bar 38 is telescopically received in the socket 36 and locked in place selectively by a hand-operable set screw 40.

The tubular socket 36 also extends rearwardly of the vertical portion 26 of the frame and includes a grinder mounting plate 42 suitably secured thereto such as by welding or the like. The mounting plate 42 extends substantially at right angles to the axis of the socket 36.

A second grinder mounting plate 44 is carried by the frame and includes an upper arm 46 and a lower arm 48. The upper arm 46 extends parallel to the split tubular socket 28 and the round tubular bar 30 of the handlebar assembly 16, while the lower arm 48 extends at an angle to the upper arm for adjustably supporting the grinder head 14.

Accordingly, the grinder plate 42 and the grinder plate 44 are spaced apart to receive therebetween the grinder head 14, and as explained below, to permit the adjustment of the grinder head to vary the position of the grinding stone.

Figure 6:
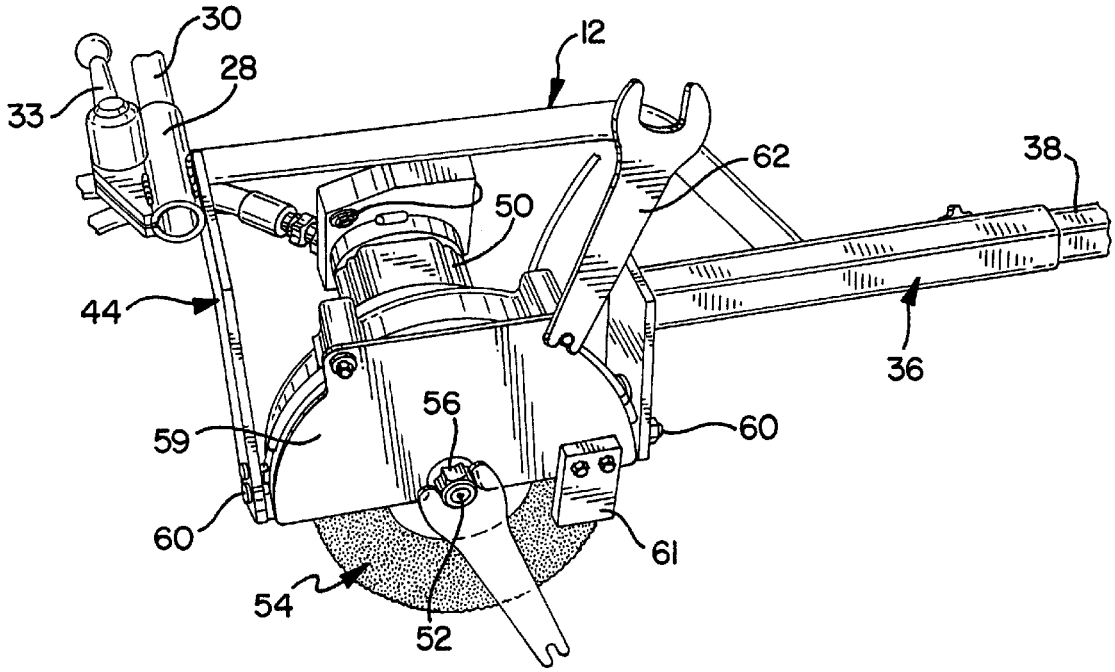
FIG. 6 is a fragmentary perspective view of the underside of the machine of the invention to illustrate the use of the wrench carried by the machine for changing the stone and/or servicing the grinder.

The grinding head 14 includes a hydraulic motor 50 having an output shaft 52 on which a disk-shaped grinding stone 54 is mounted and locked in place by a nut 56. A shroud and frame member 58 suitably secured to or integral with the housing for the hydraulic motor 50 not only shrouds a large part of the grinding stone but also provides support for the hydraulic motor and is disposed between the mounting plates 42 and 44. As seen particularly in FIG. 6, a safety plate 59 covers a substantial part of the outer side of the grinding stone 54 and further includes a bumper 61 for guarding against inadvertent engagement of the grinding stone flange and shaft with a rail. Suitable pins are provided on the shroud for being rotatably received in holes in the mounting plates 42 and 44 and are threaded to receive nuts 60 which when tightened, as explained further below, will lock the grinder head in a desired grinding position. The mounting plates 42 and 44 include portions that are offset from the frame to facilitate the operation of the adjusting means for the grinding head. Thus, loosening or tightening of the nuts 60 by the open-end wrench 62 or other suitable wrench allows adjustment of the grinding head and the stone to a desired position on the frame.

The wrench 62 has different sized sockets at each end, one of which fits on the nut 56 of the grinder shaft and the other of which fits on the other nuts on the machine including the adjusting nuts 60 for adjusting the position of the stone 54. The open-end wrench 62 is normally carried on the grinder mounting plate 44 in a suitable fashion, as shown in FIGS. 1, 2, 4, 5 and 7. However, any suitable wrench may be used.

Figure 7:
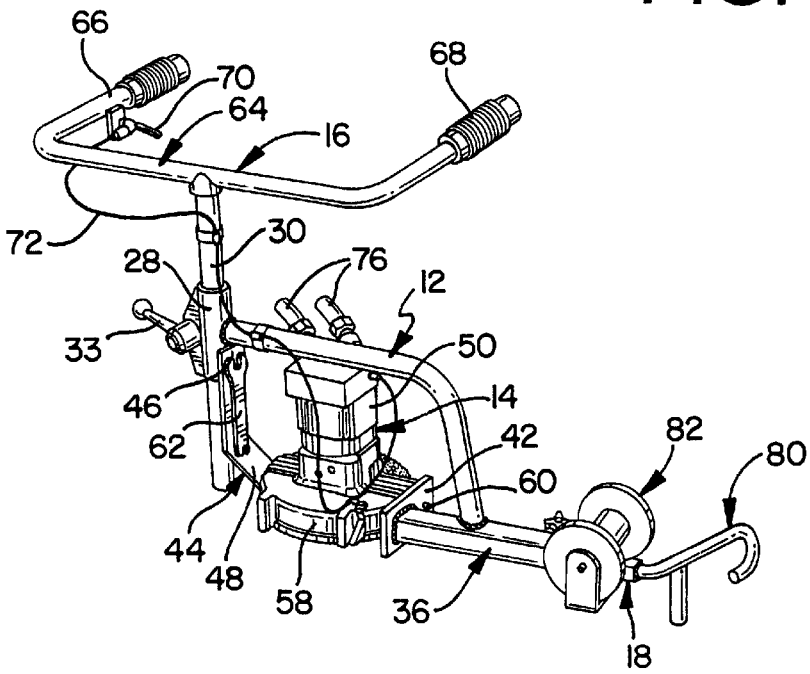
FIG. 7 is a perspective view of the machine of the invention illustrating the positioning of the handlebars for facilitating compact storage of the grinder.

Control of the machine by an operator is accomplished by gripping the handlebar assembly 16. At the upper end of the handlebar assembly tubular bar 30, a U-shaped bar 64 includes handles 66 and 68 that are gripped and engaged by the hands of the operator 20, as shown particularly in FIG. 1, for manipulating the grinding machine. Inasmuch as the handlebar assembly is adjustably mounted on the frame of the grinding machine, it may be raised or lowered relative to the frame to position it ergonomically friendly to an operator. Moreover, the handlebar assembly may be rotatably adjusted in the frame socket 28 to ergonomically fit the operator for a particular grinding task, and to facilitate compact storage, as shown in FIG. 7, wherein the handlebar assembly is rotated so that the handles 66 and 68 extend substantially perpendicular to the frame 12 and are moved downwardly.

To turn the hydraulic motor of the grinder on and off, a trigger assembly 70 is provided on the handle 68 having a pivotally mounted lever 71 that may be selectively depressed to power the grinder or released to shut down the grinder. Actuation of the trigger lever drives a shielded push-pull cable 72 that extends from the trigger assembly to a hydraulic control valve 74 on the hydraulic motor. An optional safety mechanism is available on the trigger assembly actuable by the operator prior to squeezing the trigger, thereby preventing accidental operation of the motor. Hydraulic lines 76 extend from the valve 74 and are suitably connected to a hydraulic power source that is usually available to railroad maintenance crews. Thus, releasing the optional A safety mechanism and squeezing the trigger lever actuates the control valve to turn on the grinder.

The square tubular bar 38 of the rail guide assembly 18 has mounted thereon and suitably secured thereto, such as by welding, a hook-shaped guide member 80 and a flanged wheel guide member 82. The hook-shaped guide member includes a laterally extending bar 84 secured at one end as by welding or otherwise to the end of the tubular bar 38. A hook-shaped portion 86 shaped to fit over the head of the rail 22 is provided at the other end of the bar 84, as shown particularly in FIG. 8. A pin 88 is suitably secured to the bar 84 as by welding or otherwise and extends downwardly and in spaced relation to the hook-shaped portion 86 so as to fit over the opposite side of the rail head and coact with the hook-shaped portion 86 in guiding the forward end of the machine along a rail, as seen in FIG. 8. Spacing between the hook portion 86 and the pin 88 is such that the hook-shaped guide member may be tilted on or off the rail when placing it on the rail in guiding relation with the rail or removing it from the rail. When the hook-shaped member is on the rail, it will be appreciated that the operator can slide the machine along the rail knowing that the forward end of the machine is guided by the hook-shaped guide member.

The flange wheel guide member 82 includes a wheel 90 having a cylindrical hub 92 and opposed radially extending removable wheel flanges 94 and 96. While not shown, one or the other of the flanges may be suitably removed for purposes of facilitating the guiding of the wheel. The wheel 90 is rotatably carried on a shaft 98 that is supported on a U-shaped carrier 100 that is in turn suitably secured at one end such as by welding or the like to the tubular bar 38 of the rail guide assembly 18.

It will be appreciated that by loosening and tightening the set screw 40, the tubular bar 38 may be selectively telescopically moved to position the hook-shaped guide member 80 or the wheel guide member 90 closer to or farther away from the frame 12. Further, with the set screw 40 loosened, the tubular bar with the guide members can be completely removed from the tubular socket 36 and rotated to dispose either the hook-shaped guide member 80 or the wheel guide member 82 into operative position for serving to guide and position the front end of the machine when involved in a grinding operation.

As above noted, the hook-shaped guide member is shown in guiding operation in FIG. 8, while the wheel guide member is shown in guiding operation in FIG. 9.

Referring to FIG. 10, a modified frame 12A for the machine of the invention is shown which includes a second or upper receiver 36A for the rail guide assembly 18. The receiver 36A extends substantially parallel to and is spaced above the receiver 36. The upper receiver 36A is supported at its outer free end by a tubular bar 110 extending upward from the lower receiver 36, and it is suitably connected at its inner end to the frame portion 26. The connections of the upper receiver 36A and support bar 110 are by welding or other suitable means. A hand operable set screw 40*a* is provided on the upper receiver 36A to adjustably lock the rail guide assembly in the receiver. It will be appreciated that any number of receivers may be provided to enhance the ergonomic use of the machine. Thus, in the embodiment of FIG. 10, the rail guide assembly may be mounted in either receiver as desired by the user to conduct any particular grinding task.

It can now be appreciated that depending on whether the grinding machine of the invention is to be used to grind a field weld, switch points, or a frog, it will first be set up for a particular grinding operation by adjusting the disposition of the grinding stone, choosing the appropriate guiding member, and adjusting the position of the handlebar assembly to the comfort of the operator for carrying out a chosen grinding operation.

In operation, to primarily use the machine of the invention for thermite weld profile blending or removal of weld material at welded abutting rail sections, the grinding stone is adjusted to the horizontal position and the hook-shaped guide member is used and placed in operative position with a rail head, as seen in FIG. 1.

For switch undercutting and rollover removal, the stone is adjusted to the 45 degree position, and the wheel guide member with both flanges is used and placed in riding relation on a rail.

Figure 3:
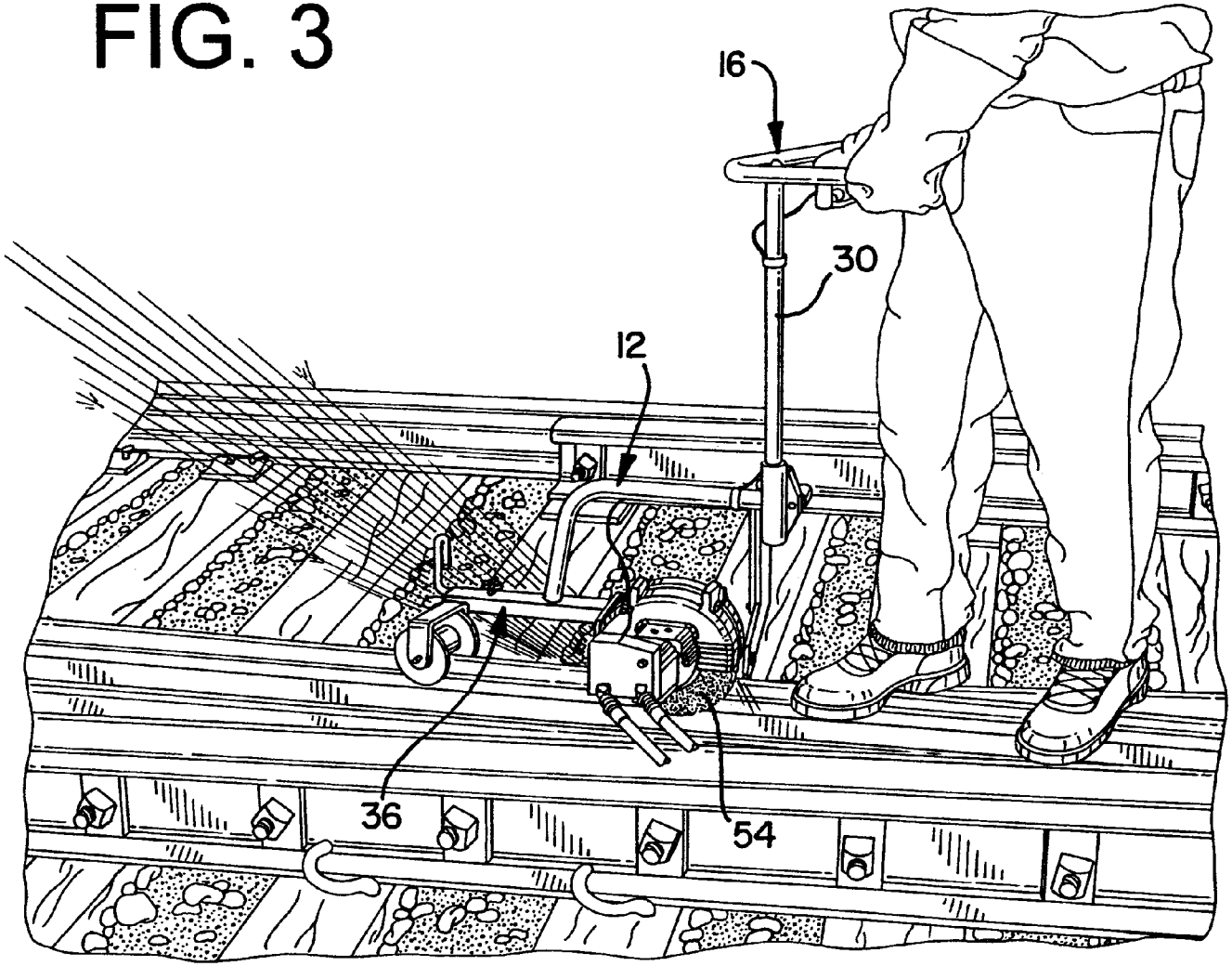
FIG. 3 is a perspective view of the machine of the invention with the grinding stone positioned vertically and the operator standing upright to operate the machine.

For rollover grinding and grinding of frog points or switch points, the grinding stone is adjusted to its vertical position, as seen in FIG. 3, and the wheel guide member with one flange removed is placed into guiding relation on a rail. Straight rollover grinding can also be accomplished with both flanges on the wheel guide member.

It will be understood that modifications and variations may be effected without departing from the scope of the novel concepts of the present invention, but it is understood that this application is to be limited only by the scope of the appended claims.

What is claimed is:

1. A portable upstanding rail grinding machine for grinding field welds connecting two rail sections, each of which includes a head, a web, and a base, switch points, and frogs, comprising:

a frame, a motorized grinder having a disk-shaped grinding stone, means mounting the grinder on the frame for adjustably setting the stone between horizontal and vertical positions and therebetween, a rail guide assembly for guiding the machine along a rail and including at least one rail engaging guide member, said frame including a receiver for adjustably receiving said rail guide assembly to dispose said rail-engaging guide member in position to guide the machine along a rail, handlebars carried by the frame and extending upwardly for gripping by an operator standing in a substantially upright position to move the machine along a rail, and trigger means on the handlebars for selectively operating the motorized grinder, whereby said grinding machine with the grinder in generally horizontal position is capable of grinding that part of the field weld below the head of the rail while the operator is standing in a substantially upright position.

2. The portable upstanding rail grinding machine of claim 1, wherein said motorized grinder is driven by a hydraulic motor.

3. The portable upstanding rail grinding machine of claim 1, wherein said rail engaging member is a flanged wheel.

4. A portable upstanding rail grinding machine for grinding field welds, switch points, and frogs, comprising;

a frame, a hydraulically driven grinder having a disk-shaped grinding stone, means mounting the grinder on the frame for adjustably setting the stone between horizontal and vertical positions and therebetween, an adjustable rail guide assembly carried by the frame for guiding movement of the machine along a rail and including a hook-shaped rail engaging member and a flanged wheel rail engaging member, a pair of handlebars carried on the frame and positionable for gripping by an operator standing in a substantially upright position, and trigger means on one of the handlebars for actuation by the operator to selectively operate the hydraulically driven grinder.

5. The portable upstanding rail grinding machine of claim 4, which further includes means for adjustably mounting said handlebars for selective ergonomical operation or for compact storage.

6. The portable upstanding rail grinding machine of claim 5, which further includes safety means for operating the trigger means.

7. A portable upstanding rail grinding machine for grinding field welds, switch points, and frogs, comprising:

a frame, a hydraulically driven grinder having a disk-shaped grinding stone, means mounting the grinder on the frame for adjustably setting the stone between horizontal and vertical positions and therebetween, a rail guide assembly for guiding movement of the machine, said rail guide assembly including a plurality of rail-engaging members extending from a mounting bar, said frame including at least one receiver for adjustably receiving said mounting bar to dispose one rail-engaging member in position to serve as a guide for the frame, a pair of handlebars carried on the frame and positionable for gripping by an operator standing in a substantially upright position, and trigger means on one of the handlebars for actuation by the operator to selectively operate the hydraulically driven grinder.

8. The portable upstanding rail grinding machine of claim 7, which further includes means for adjustably mounting said handlebars for selective ergonomical operation or for compact storage.

9. The portable upstanding rail grinding machine of claim 7, wherein said frame includes a plurality of receivers for adjustably receiving said mounting bars of said rail guide assembly.

10. The portable upstanding rail grinding machine of claim 7, said frame including upper and lower receivers for selectively receiving the mounting bar of said rail guide assembly at an upper or lower position on the frame.

11. A portable upstanding rail grinding machine for grinding field welds, switch points, and frogs, comprising:

a frame, a motorized grinder having a disk-shaped grinding stone, means mounting the grinder on the frame for adjustably setting the stone between horizontal and vertical positions and therebetween, an adjustable rail guide assembly carried by the frame for guiding the machine along a rail and including at least one rail engaging guide member, handlebars carried by the frame and extending upward for gripping by an operator standing in a substantially upright position, means for adjustably mounting the handlebars on the frame which permits changes in the elevation of the handlebars relative to the frame and changes in the angular relation between the handlebars and the frame to provide ergonomic operation and to facilitate compact storage of the machine, and trigger means on the handlebars for selectively operating the motorized grinder.

12. The portable upstanding rail grinding machine of claim 11, wherein said adjustable rail guide assembly includes a plurality of rail engaging members.

13. A portable upstanding rail grinding machine for grinding field welds, switch points, and frogs, comprising:

a frame, a motorized grinder having a disk-shaped grinding stone, means mounting the grinder on the frame for adjustably setting the stone between horizontal and vertical positions and therebetween, an adjustable rail guide assembly carried by the frame for guiding the machine along a rail and including at least one rail engaging guide member, said rail-engaging member is hook-shaped, handlebars carried by the frame and extending upward for gripping by an operator standing in a substantially upright position, and trigger means on the handlebars for selectively operating the motorized grinder.

14. A portable upstanding rail grinding machine for grinding field welds, switch points, and frogs, comprising:

a frame, a motorized grinder having a disk-shaped grinding stone, means mounting the grinder on the frame for adjustably setting the stone between horizontal and vertical positions and therebetween, an adjustable rail guide assembly carried by the frame for guiding the machine along the rails and including a plurality of rail-engaging members, one of said rail-engaging members is in the form of a hook and the other is in the form of a flanged wheel, handlebars carried by the frame and extending upward for gripping by an operator standing in a substantially upright position, and trigger means on the handlebars for selectively operating the motorized grinder.

15. The portable upstanding rail grinding machine of claim 14, which further includes means for adjustably mounting said rail guide assembly on the frame to vary the spacing of the rail engaging members from the frame and the grinding stone.

16. The portable upstanding rail grinding machine of claim 15, wherein said means for adjusting said rail guide assembly on the frame also permits the positioning either of the rail engaging members for use to guidingly engage the rail.

17. A portable upstanding rail grinding machine for grinding entire field welds connecting end-to-end rail sections, wherein the rail sections include a head, a web and a base, said machine comprising:

a frame, a motorized grinder having a disk-shaped grinding stone, means mounting the grinder on the frame for adjustably setting the stone between horizontal and vertical positions and therebetween, a rail guide assembly for guiding the machine along a rail and including at least one rail engaging guide member, said frame including means for adjustably receiving said rail guide assembly to dispose said rail engaging guide member in position to guide the machine along a rail, handlebars carried by the frame and extending upwardly for gripping by an operator standing in a substantially upright position to move the machine along a rail, and control means for selectively operating the motorized grinder, whereby said grinding machine with the grinder in generally horizontal position is capable of grinding that part of the field weld below the head of the rail while the operator is standing in a substantially upright position.

18. A portable upstanding rail grinding machine as defined in claim 17, wherein said control means includes a hand-operated lever mounted on the handlebars.

* * * * *